United States Patent [19]

Nimerick

[11] Patent Number: 4,732,669

[45] Date of Patent: Mar. 22, 1988

[54] CONDITIONER FOR FLOTATION OF COAL

[75] Inventor: Kenneth H. Nimerick, Tulsa, Okla.

[73] Assignee: The Dow Chemical Company, Midland, Mich.

[21] Appl. No.: 888,319

[22] Filed: Jul. 21, 1986

[51] Int. Cl.[4] ..... B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 2,112,362 | 3/1938 | Gillson | 209/166 |
| 2,861,687 | 11/1958 | Lord | 209/166 |
| 4,276,156 | 6/1981 | Hefner, Jr. . | |
| 4,305,815 | 12/1981 | Hefner, Jr. . | |
| 4,330,339 | 5/1982 | Nimerick . | |
| 4,474,619 | 10/1984 | Meyer et al. . | |
| 4,504,385 | 3/1985 | Keys . | |
| 4,582,596 | 4/1986 | Hansen | 209/166 |
| 4,606,818 | 8/1986 | Keys | 209/166 |

OTHER PUBLICATIONS

"Effect of Oxidation of Coals on Their Flotation Properties" by Shiou-Chuan Sun, Transactions of AIME 199: pp. 396–401 (1954).

"*Organic Chemistry*" by Fessenden & Fessenden, copyright 1979 by Willard Grant Press, pp. 584–586.

Kirk-Othmer, Encyclopedia of Chemical Technology, 2nd Ed., vol. 15, pp. 749–752 (1981).

*Primary Examiner*—S. Leon Bashore

*Assistant Examiner*—Thomas M. Lithgow

[57] ABSTRACT

The froth flotation of coal is conducted in the presence of a conditioner of the condensate of naphthenic acid and an alkanolamine such as diethanolamine.

16 Claims, No Drawings

CONDITIONER FOR FLOTATION OF COAL

BACKGROUND OF THE INVENTION

This invention relates a method for the froth flotation of coal and, more particularly, to the use of a condensation product of an alkanolamine and naphthenic acid as a conditioner for the flotation of coal.

Combustible carbonaceous solid material ("coal") is inherently found in deposits containing non-combustible mineral matter. Although large fragments of the non-combustible materials can be removed by screening or conventional gravity concentration techniques such as centrifugation, froth flotation is more commonly employed to remove the coal from the finer non-combustible materials. In froth flotation, a frother such as methyl isobutyl carbinol. In the flotation process, it is desirable to recover as much coal as possible while effecting the recovery in a selective manner, i.e., minimizing the amounts of undersirable material or ash in the froth. Unfortunately, many coals, e.g., coals in which the surface has been at least partially oxidized such as sub-bituminous and anthracite coals, are difficult to float. This results in an undesirable loss of significant amounts of combustible material in the tail from the flotation.

Increases in the amounts of this so-called "hard-to-float" coal recovered in the froth can be improved by increasing the concentration of the oil-type collector employed in the flotation process. Unfortunately, acceptable recovery can often be effected using such high amounts of the oil-type collector that significant amounts of the non-combustible matter are floated with the coal. Sun suggests in *Trans. AIME,* 199:396–401 (1954), that fatty amines can be utilized as co-collectors in the flotation of oxidized coals to effect enhanced recovery. However, even these amine collectors float substantial amounts of ash along with the coal and effect only partial recovery of combustible material.

A variety of other materials have been suggested for use into beneficiate coal in a froth flotation process. Such materials include the condensation product of a fatty acid or fatty acid ester with the reaction product of a polyalkylenepolyamine and an alkylene oxide (U.S. Pat. No. 4,305,815); the condensation product of an alkanolamine and a fatty acid or fatty acid ester (U.S. Pat. No. 4,474,619) and the reaction product of the condensation product of diethanolamine and a $C_{10-24}$ fatty acid with a $C_{1-4}$ monocarboxylic acid (U.S. Pat. No. 4,330,339). These materials can be effectively employed in the flotation of coal and are capable of the selective recovery of coal over ash at excellent rates of recovery. However, the fatty acid component of the conditioner is subject to variation in cost. In addition, further improvements in the selectivity of the froth flotation process or in the rate of coal recovery are always desirable.

Therefore, it is desirable to provide an alternative method for conditioning or beneficiating coal which gives equivalent or better performance than existing methods.

SUMMARY OF THE INVENTION

The present invention is a method for recovering coal using froth flotation. Specifically, the froth flotation method of the present invention comprises the step of floating coal in a frothing aqueous medium containing an effective amount of a condensation product of an alkanolamine and naphthenic acid.

The method of the present invention can be employed to effectively recover coal. It is particularly useful in the recovery of the so-called "hard-to-float" coals. A relatively high selectivity of coal over ash and other non-combustible materials at excellent rates of recovery can often be obtained.

DETAILED DESCRIPTION OF THE INVENTION

The alkanolamine useful in preparing the condensation product to be employed as a conditioner in the method of the present invention is suitably any alkanolamine which can be reacted with a naphthenic acid or a naphthenic acid ester to form a condensation product which can be employed as a conditioner in the recovery of coal. Alkanolamines which can be employed in the preparation of the condensation product include unsubstituted or N-alkyl substituted monoethanolamine; diethanolamine; triethanolamine; hydroxyethylethylenediamine; N,N'-di(hydroxyethyl)ethylenediamine; N,N-di(hydroxyethyl)ethylenediamine; N,N,N'-tri(hydroxyethyl)ethylenediamine; N,N,N',N'-tetra(hydroxyethyl)ethylenediamine; and like compounds in which the ethylene moiety is replaced by a $C_{3-8}$ alkylene, preferably a propylene and/or the hydroxyethyl group is replaced by a $\beta$-hydroxyalkyl group having from 3 to 5 carbon atoms. For reasons of economics the hydroxyalkyl group is advantageously a hydroxyethyl, 1-methyl(hydroxyethyl) or 1-ethyl(hydroxyethyl) group.

These alkanolamines can be represented generally by the formula:

$$(R_3)(R_2)N(R_1)$$

wherein $R_1$ is a $\beta$-hydroxyalkyl group or inertly substituted $\beta$-hydroxyalkyl group having from 2 to 5 carbon atoms; and $R_2$ and $R_3$ are independently $R_1$, hydrogen, an alkyl group of from 1 to 4 carbon atoms or a monovalent group corresponding to the formula:

$$(R_4)(R_5)N(CH_2)_y-$$

wherein y is an integer of 2 or 3 and $R_4$ and $R_5$ are independently $R_1$, hydrogen, or alkyl of from 1 to 4 carbon atoms.

The unsubstituted alkanolamines bearing only hydroxyethyl and ethylene moieties are preferred. Diethanolamine, triethanolamine and di- tri- or tetra(hydroxyethyl)ethylenediamine are especially preferred alkanolamines with diethanolamine being most preferred. Although a single alkanolamine can be employed, for pratical reasons, a mixture of alkanolamines are preferred for economic reasons. The alkanolamines and their method of preparation are well-known in the art. Many of the alkanolamines are available commercially or can be readily prepared by reactions of a manner known to the art.

The term "naphthenic acid" is used conventionally herein and refers to saturated higher fatty acids comprising single or fused cyclopentyl rings (a fraction of which may be cyclohexyl) which are alkylated in various positions with short aliphatic groups. In general, naphthenic acids are most commonly available as a mixture of carboxylic acids having from 1 to 5 rings (generally cyclopentyl rings but a portion of which may be cylohexyl) which rings may or may not be substituted with a small aliphatic group, e.g., methyl or ethyl.

Such acids are well known in the art. See, for example, *Kirk-Othmer, Encyclopedia of Chemical Technology,* 2nd Ed., Vol. 15, pp. 749–752 (1981), which is herein incorporated by reference. In general, the naphthenic acids are derived from petroleum during the refining of various distilled fractions, with most of the commercial acids being derived from the kerosene and gas-oil fractions and the higher molecular weight acids being derived from the light lubricating-oil cuts. In general, refined naphthenic acids (as opposed to crude naphthenic acids) are most often advantageously used in preparing the condensation product, but at least partially for economical reasons, crude naphthenic acid are often most advantageously employed. The more preferred naphthenic acids for use in the method of the present invention are those acids having an acid number from about 125 to about 250 milligrams KOH per gram (mg KOH/g) and a molecular weight from about 200 to about 400, with naphthenic acid having an acid number of from about 150 to 225, most preferably from 175 to 200, mg KOH/g and a weight average molecular weight of from 275 to 350 being most preferred.

The alkanolamine and naphthenic acid are reacted in amounts sufficient to form a condensation product which is useful as a conditioner in the recovery of coal using froth flotation techniques. The proportion of the alkanolamine and naphthenic acid most advantageously employed in preparing the condensation product will vary depending on a variety of factors including the specific alkanolamine and naphthenic acid employed, the desired properties of the condensation product and its end use application. In general, although the naphthenic acid can be employed at less than equimolar amounts, the condensation product is most effective as a conditioner when at least an equimolar amount of the naphthenic acid or its equivalent is condensed with the alkanolamine. The molar ratio of the naphthenic acid to the alkanolamine is preferably from at least about 1:1 to about 5:1. Although it is not easy to react all the reactive sites on the alkanolamine with the naphthenic acid, the number of moles of naphthenic acid used in preparing the condensate can exceed the number of moles of alkanolamine multiplied by the average number of reactive sites on a molecule of the alkanolamine since naphthenic acid is also often an effective conditioner. The term "reactive sites" refers to the exchangeable hydrogen substituents on the amine groups and the reactive hydroxyl substituents on the hydroxyalkyl group, which will react with the naphthenic acid to produce amides. In general, from about 1.8 to 3, most preferably from about 1.9 to about 2.25 moles of the naphthenic acids are employed for each mole of the alkanolamine.

In general, the condensation products can be employed as conditioners without further modification. If the alkanolamine is not completely reacted, i.e., some of the reactive sites remain, it is also possible to react the unreacted sites with an acid to prepare a derivative of the condensate which is also useful as a conditioner. These derivatives can be prepared by adding an inorganic acid (such as phosphoric, nitric, boric, hydrochloric, hydrobromic and sulfuric acid) or an organic acid, preferably an organic acid, to the condensate so as to reduce the pH of the resulting mixture. The derivative may be either a salt, partial salt or an acid complex. Organic acids useful for this purpose include aliphatic mono-, di-, or tricarboxylic acids; lower alkyl carboxylic acids; mono- or dihydroxy lower alkyl carboxylic acids; amino-substituted carboxylic acids and unsaturated aliphatic carboxylic acids. Examples of these organic acids include formic, acetic, hydroxyacetic, propionic, butyric, isovaleric, lactic gluconic, glutaric, fumaric, citric, salicyclic and benzoic acids. Acetic acid and other lower alkyl organic carboxylic acids, especially the $C_1$ to $C_4$ organic acids, are preferred. In one especially preferred embodiment 0.5 mole of acetic or propionic acid is added per mole of a condensate prepared from 1 equivalent of diethanolamine condensed with two equivalents of naphthenic acid.

The condensation product is employed in an effective amount. By the term "effective amount", it is meant that the condensation product is employed in an amount sufficient to increase the recovery of coal as compared to the recovery of coal in an identical process except using no condensate conditioner. The condensate is most advantageously employed in amounts which give the greatest recovery of combustible carbonaceous matter with a tolerable amount of ash and other non-combustible or inert matter. These amounts of condensation product are dependent on a variety of factors including the size, rank, degree of oxidation and inert matter content of the coal feed, the specific frother, if any, employed and its concentration as well as the type and concentration of any other materials employed in the froth flotation process. Generally, the aqueous frothing medium contains from about 0.001 to about 1.0, preferably about 0.002 to about 0.2 kilograms of condensate per ton of coal flotation feed (dry weight basis).

The instant condensation product can be utilized in conjunction with other conditioners or collectors and other adjuvants such as activators, dispersing reagents, frothers, depressing agents and the like.

Of these materials, a frother is commonly employed in the froth flotation process to promote formation of a froth. Any material capable of promoting the formation of the froth can be employed as a frother herein. Conventionally, frothers are materials containing one or more hydroxyl groups although other materials which are capable of promoting the formation of a froth can also be employed. Representative frothers include monohydroxylated compounds such as pine oil, cresol, $C_4$ to $C_8$ alkanols containing one or two tertiary or one quaternary carbon atom, the reaction product of a $C_{1-6}$ monohydroxy alcohol and propylene oxide or a mixture of propylene oxide and butylene oxide, $C_{1-4}$ alkyl ethers of polypropylene glycols reacted with propylene oxide, terpinol, methyl isobutyl carbinol; dihydroxylated compounds such as polypropylene glycol; and tri- or higher-hydroxylated compounds such as the reaction product of a $C_{1-20}$ alkane, sucrose, a monosaccharide, disaccharide or a $C_{3-20}$ cycloalkane having three or more hydroxy groups with propylene oxide or a mixture of propylene oxide and ethylene oxide such as described in U.S. patent application Ser. No. 646,339, filed Aug. 29, 1984.

Preferred frothers are methyl isobutyl carbinol, polypropylene methyl ethers having a weight average molecular weight between about 200 and about 600, the reaction product of $C_{4-6}$ alcohols and propylene oxide, and the reaction product of a $C_{1-20}$ alkane or $C_{3-20}$ cycloalkane having from three to about ten hydroxy groups, with propylene oxide. The reaction product of a $C_{4-6}$ monohydroxy alcohol and propylene oxide and the reaction product of a $C_{1-20}$ alkane or $C_{3-20}$ cycloalkane having from three to eight hydroxy groups with propylene oxide are most preferred.

The amount of frother most advantageously employed in the flotation medium is influenced by a number of factors, most important of which is the rank and degree of oxidation of the coal. Generally, the frother is preferably employed in an amount from about 0.05 to about 0.5 kilogram frother per ton of coal feed (dry weight basis).

A fuel oil collector is also commonly employed in the flotation medium and the froth flotation process of the present invention is most preferably conducted using a fuel oil collector or conditioner. Representative fuel oils include diesel oil, kerosene, Bunker C fuel oil, mixtures thereof and the like. The optimal amount of fuel oil in the flotation medium is influenced by numerous factors including the size, degree of oxidation and rank of the coal to be floated and the amount of condensate and frother, if any, employed. In general, the fuel oil can be advantageously employed in an amount from about 0.01 to about 2.5, preferably from about 0.02 to about 1.5, kilograms fuel oil per ton of coal flotation feed (as calculated on a dry weight basis). In one preferred embodiment, the conditioner is charged to the flotation medium dispersed in part or all of the fuel oil charge.

In addition, the naphthenic acid/alkanolamine condensate can be employed in combination with other conditioners such as the condensation products of a fatty acid or fatty acid ester with an alkanolamine such as described in U.S. Pat. No. 4,474,619; the condensation product of a fatty acid or fatty acid ester with the reaction product of a polyalkylenepolyamine and an alkylene oxide such as described in U.S. Pat. No. 4,305,815; the reaction product of the condensation product of diethanolamine and a $C_{10-24}$ fatty acid with a $C_{1-4}$ monocarboxylic acid such as described in U.S. Pat. No. 4,330,339; and aryl sulfonates such as described in U.S. Pat. No. 4,308,133. In many flotation operations, a combination of the naphthenic acid/alkanolamine condensate and the fatty acid/alkanolamine condensate is preferred. In general, when the fatty acid/alkanolamine condensate and naphthenic acid/alkanolamine condensate are employed in combination, the total amount of the aqueous frothing medium advantageously contains from about 0.001 to about 1.0, preferably about 0.002 to about 0.2 kilogram of condensate per ton of coal flotation feed. When employed in combination, the naphthenic acid/alkanolamine condensate is advantageously employed in an amount of from about 10 to about 70, preferably from about 20 to about 60, weight percent and the fatty acid/alkanolamine condensate employed in an amount of from about 30 to about 90, preferably from about 40 to about 80, weight percent based on the weight of the naphthenic acid/alkanolamine and fatty acid/alkanolamine condensates.

The process of the present invention can be employed to float anthracite, bituminous, sub-bituminous or the like. The process is preferably employed to float coal which cannot be effectively floated using conventional frothers alone and is particularly effective in the flotation of bituminous coal of intermediate or low rank, where the surface of the coal is oxidized to an extent which significantly impedes the floatation of the coal using conventional agents.

Although coal as large as 10 mesh has been floated using froth flotation processes, in general, the size of the coal particles to be separated by flotation are generally less than about 28 mesh (U.S. Sieve Size). If a substantial fraction of the coal in the flotation feed comprises particles larger than 28 mesh, it is generally desirable that the feed be comminuted further prior to flotation. The weight average particle size of the coal to be floated is generally from about 177 (80 mesh) to about 125 micrometers (120 mesh).

The sized coal flotation feed optionally is first washed and then mixed with sufficient water to prepare an aqueous slurry having a solids concentrate which promotes rapid flotation. Generally, a solids concentration between about 2 to about 20 weight percent solids, more preferably from about 5 to about 10 weight percent, is employed. The aqueous coal slurry is advantageously conditioned with the condensation product, a frother, a fuel oil collector and any other adjuvants using methods known to the art. For difficult to float coal, it is generally advantageous to contact the coal slurry with the conditioner and fuel oil prior to flotation at conditions which effect intimate contact of the conditioner and fuel oil with substantially all of the coal. In those instances where the aqueous coal slurry is prepared in a container distinct from the flotation cell and then is conveyed to the flotation medium, the desired intimate contact can conveniently be attained by introducing the conditioner and fuel oil to the slurry upstream from the flotation cell. Although the frother can be introduced to the slurry during conditioning, it is more preferable to add the frother to the slurry only shortly before flotation or during flotation.

The coal can be floated at the natural pH of the coal in the aqueous slurry, which will conventionally vary from about 3.0 to about 9.5. However, the pH of the aqueous coal slurry is advantageously maintained, prior to and during flotation, at a value from about 4 to about 9, preferably about 4 to about 8, which generally promotes the greatest coal recovery. If the coal is acidic in character, the pH can be adjusted using an alkaline material such as soda ash, lime, ammonia, potassium hydroxide or magnesium hydroxide, with sodium hydroxide being preferred. If the aqueous coal slurry is alkaline in character, a carboxylic acid, such as acetic acid or the like, or a mineral acid, such as sulfuric acid, hydrochloric acid and the like, can be employed to adjust the pH.

The conditioned and pH-adjusted aqueous coal slurry is aerated in a conventional flotation machine or bank of rougher cells to float the coal. Any suitable rougher flotation unit can be employed.

The practice of the process of the instant invention can be used alone to beneficiate coal. Alternatively, the process can be used in conjunction with secondary flotations following the instant process to effect even greater beneficiation of the coal.

The following examples are included to illustrate the invention only and should not be construed to limit its scope. Unless otherwise indicated, all parts and percentages are by weight.

EXAMPLE 1

A 286 gram (g) charge of coal having a known ash content is added to the bottom of a Wemco type froth flotation cell and is diluted with deionized water to form a slurry of 6.8 percent solids. The coal is Clarion 4A seam coal, a coal recognized as a hard-to-float coal, having a particle size of less than 28 mesh (500 micrometer) with more than 90 percent of the particles being smaller than 80 mesh.

The pH of the slurry is determined to be about 4.6. The coal slurry is agitated for about seven minutes to thoroughly wet the coal, at which time the pH is adjusted to 6.8 by the addition of sufficient amounts of sodium hydroxide. At the end of this time, a mixture comprising 90 percent diesel fuel oil and 10 percent of a blend comprising 30 percent kerosene, 3.2 percent acetic acid and 66.8 percent of a condensate prepared from a molar ratio of 1 part diethanolamine (DEA) and 2 moles of a refined naphthenic acid having an acid number of 150 mg KOH/g and a molecular weight of 335 sold as Agenap HMW-P by CPS Chemical is added to the slurry in an amount of about 0.28 kilogram (kg) per ton of coal feed (dry weight basis). This corresponds to adding about 0.028 kg/ton of the naphthenic acid/alkanolamine condensate. A frother is also added to the slurry in an amount of about 0.14 kg per ton of coal feed (dry weight basis). The frother is a propylene glycol having a weight average molecular weight of about 400 sold under the tradename of DOWFROTH 1012. After the addition of the flotation agents, the slurry is conditioned by agitation for about 20 seconds, after which aeration of the slurry is initiated and the paddles started. Samples of the frothy concentrate are collected at various times during aeration.

The collected concentrate ("heads") are dewatered using a vacuum filter and then dried in a drying oven. The percent recovery of coal at three minutes is determined from the weight of coal in the concentrate divided by the weight of coal (i.e., total weight less weight of ash) in the charge. The percent recovery of ash at three minutes is determined using similar techniques, with the ash content of the concentrate being determined using ASTM test method designated 3774-73. The rate constant of the flotation process and the amount of recovery at infinite time is determined using the formula:

$$\gamma = R_\infty.[1-(1-e-Kt)/(Kt)]$$

wherein $\gamma$ is the amount of coal or ash recovered at time t, K is the rate constant for the rate of recovery and $R_\infty$ is the calculated amount of the mineral which would be recovered at infinite time. The amount of coal or ash recovered at various times, as determined experimentally, are employed to obtain K and $R_\infty$. The above equation is explained in Klimpel, Selection of Chemical Reagents for Flotation, Chapter 45, pp. 907–934, *Mineral Processing Plant Design,* 2nd Ed., 1980, AIME (Denver) which is hereby incorporated by reference. The percent recovery of coal and ash at three minutes, the percent recovery of coal and ash at an infinite time and the rate of coal and ash recovery are determined and set forth in Table I.

COMPARATIVE EXAMPLE A

A flotation run is conducted in an identical manner to Example 1 except that no conditioner is employed in the flotation. However, 0.28 kg/ton of diesel oil are employed as the collector. The percent recovery of coal and ash at three minutes, the percent recovery of coal and ash at an infinite time and the rate of coal and ash recovery are determined and set forth in the accompanying Table.

COMPARATIVE EXAMPLE B

A flotation run is conducted in an identical manner to Example 1 except that a condensation product of 1 mole of diethanolamine and 2 moles of tall oil fatty acid as described in Example 1 of U.S. Pat. No. 4,474,619 is employed in place of the DEA/naphthenic acid condensate in the flotation process. The percent recovery of coal and ash at three minutes, the percent recovery of coal and ash at an infinite time and the rate of coal and ash recovery are determined and set forth in the accompanying Table.

EXAMPLE 2

A flotation run is conducted in an identical manner to Example 1 except that the condensation product of 1 mole of diethanolamine and 2 moles of crude naphthenic acid is employed in the flotation. The percent recovery of coal and ash at three minutes, the percent recovery of coal and ash at an infinite time and the rate of coal and ash recovery are determined and set forth in the accompanying Table.

EXAMPLES 3–6

A series of flotation runs are conducted in the same manner as Example 1 except using a conditioner blend containing the amounts of the condensation reaction product of 1 mole of diethanolamine and 2 moles of naphthenic acid and the condensation product of 1 mole of diethanolamine and 2 moles of tall oil fatty acid as described in Example 1 of U.S. Pat. No. 4,474,619 as set forth in the accompanying Table. In Example Nos. 3 and 4, the naphthenic acid employed is a crude naphthenic acid and in Example Nos 5 and 6, the naphthenic acid is a refined naphthenic acid. The percent recovery of coal and ash at three minutes, the percent recovery of coal and ash at an infinite time and the rate of coal and ash recovery are determined and set forth in the accompanying Table for each run.

TABLE

| Example | Conditioner[1] | | % Coal | % Ash | % Ash | Coal | | Ash | | Selectivity, Coal/Ash | |
|---|---|---|---|---|---|---|---|---|---|---|---|
| Number | Type | Amount, g/ton | Recovery (3 min) | Recovery (3 min) | in Product (3 min) | $R_\infty$ | K | $R_\infty$ | K | $R_\infty$ | K |
| 1 | N. Acid/DEA | 18.7 | 80.5 | 27.0 | 14.9 | 88.9 | 4.0 | 33.1 | 2.4 | 2.69 | 2.4 |
| 2 | N. Acid/DEA | 18.7 | 79.7 | 28.0 | 15.3 | 92.1 | 3.2 | 32.8 | 2.0 | 2.81 | 2.0 |
| 3 | N. Acid/DEA | 9.35 | 80.2 | 27.4 | 14.8 | 88.9 | 4.3 | 31.8 | 2.5 | 2.80 | 2.5 |
| | F. Acid/DEA | 9.35 | | | | | | | | | |
| 4 | N. Acid/DEA | 9.35 | 81.4 | 30.7 | 16.3 | 89.7 | 4.6 | 35.1 | 2.8 | 2.56 | 2.8 |
| | F. Acid/DEA[2] | 9.35 | | | | | | | | | |
| 5 | N. Acid/DEA | 9.35 | 81.6 | 27.4 | 14.5 | 94.8 | 3.8 | 34.5 | 1.7 | 2.75 | 1.7 |
| | F. Acid/DEA | 9.35 | | | | | | | | | |
| 6 | N. Acid/DEA | 4.67 | 77.0 | 27.8 | 15.6 | 83.7 | 5.2 | 31.3 | 3.1 | 2.67 | 3.1 |
| | F. Acid/DEA | 14.03 | | | | | | | | | |
| A | None | 0 | 58.8 | 21.7 | 15.8 | 66.1 | 3.7 | 25.2 | 2.5 | 2.6 | 1.5 |

TABLE-continued

| Example Number | Conditioner[1] Type | Amount, g/ton | % Coal Recovery (3 min) | % Ash Recovery (3 min) | % Ash in Product (3 min) | Coal R∞ | Coal K | Ash R∞ | Ash K | Selectivity, Coal/Ash R∞ | Selectivity, Coal/Ash K |
|---|---|---|---|---|---|---|---|---|---|---|---|
| B | F. Acid/DEA | 18.7 | 76.5 | 25.1 | 15.5 | 83.4 | 5.1 | 28.5 | 3.1 | 2.93 | 3.1 |

[1]The Type and Amount of Conditioner refer to the condensate and the amounts of conditioner employed. The condensate, in all case, is employed as a blend in diesel oil and acetic acid. In the Examples, the diesel oil is not considered to be a conditioner.
[2]In this Example, the naphthenic acid and tall oil fatty acid are simultaneously reacted with DEA to form the conditioner mixture rather than separately reacted and then blended.

As evidenced by the data set forth in the foregoing Table, the flotation method of the present invention which employs a condensate of naphthenic acid and diethanolamine as a coal conditioner provides enhanced recovery of coal relative to flotation systems using only diesel oil. Moreover, the recovery of undesirable ash is reduced, thereby improving the overall selectivity of the flotation method as compared to flotation methods of the prior art. In addition, the naphthenic acid/alkanolamine condensate shows equivalent or higher recoveries of coal than a fatty acid/alkanolamine condensate.

What is claimed is:

1. A method for recovering coal which comprises the steps of floating coal in an aqueous frothing medium containing an amount of a condensation product of an alkanolamine and naphthenic acid. sufficient to increase the recovery of coal as compared to the recovery of coal in an identical proces using none of said condensation product.

2. The method of claim 1 wherein the alkanolamine comprises an alkanolamine of the formula:

$$(R_3)(R_2)N(R_1)$$

wherein $R_1$ is a $\beta$-hydroxyalkyl group or inertly substituted $\beta$-hydroxyalkyl group having from 2 to 5 carbon atoms; and $R_2$ and $R_3$ are independently $R_1$, hydrogen, an alkyl group of from 1 to 4 carbon atoms or a monovalent group corresponding to the formula:

$$(R_4)(R_5)N(CH_2)y-$$

wherein y is an integer of 2 or 3 and $R_4$ and $R_5$ are independently R1, hydrogen, or alkyl having from 1 to 4 carbon atoms.

3. The method of claim 2 wherein the alkanolamine(s) bear only hydroxyethyl and ethylene moieties.

4. The method of claim 1 wherein the alkanolamine comprises diethanolamine, triethanolamine or di- tri- or tetra(hydroxyethyl)-ethylenediamine.

5. The method of claim 1 wherein the naphthenic acid/alkanolamine condensate is prepared by reacting from at least about 1 to about 5 moles of naphthenic acid for each mole of alkanolamine.

6. The method of claim 5 wherein the alkanolamine comprises diethanolamine and the condensate is prepared from about 1.9 to about 2.25 moles of the naphthenic acids for each mole of the alkanolamine.

7. The method of claim 1 wherein the coal has an oxidized surface.

8. The method of claim 1 wherein the aqueous frothing medium contains a fuel oil collector/conditioner.

9. The method of claim 8 wherein from about 0.02 to about 2.5 kilograms of the fuel oil are employed per ton of coal flotation feed (as calculated on a dry weight basis).

10. The method of claim 8 wherein the aqueous frothing medium further contains a condensate of an alkanolamine and a fatty acid or fatty acid ester.

11. The method of claim 10 wherein the naphthenic acid/alkanolamine condensate is employed in an amount of from about 10 to about 70 weight percent and the fatty acid/alkanolamine condensate employed in an amount of from about 30 to about 90 weight percent based on the weight of the naphthenic acid/alkanolamine and fatty acid/alkanolamine condensates.

12. The method of claim 8 wherein the aqueous frothing medium further comprises a frother.

13. The method of claim 12 wherein the frother is employed in an amount of from about 0.05 to about 0.5 kilogram frother per ton of coal feed (dry weight basis).

14. The method of claim 13 wherein the frother is methyl isobutyl carbinol or a polypropylene methyl ether having a weight average molecular weight between about 200 and about 600, or the reaction product of $C_{4-6}$ alcohols and propylene oxide.

15. The method of claim 13 wherein the frother is the reaction product of sucrose; or a monosaccharide, disaccharide, $C_{1-20}$ alkane or $C_{3-20}$ cycloalkane having three or more hydroxy groups with propylene oxide or a mixture of propylene oxide and ethylene oxide.

16. A method of recovering coal which comprises the steps of floating coal in an aqueous frothing medium containing from about 0.001 to about 1.0 kilogram per ton of a coal flotation feed of a condensation product of an alkanolamine and naphthenic acid.

* * * * *